United States Patent [19]

Stein

[11] 4,282,456

[45] Aug. 4, 1981

[54] FACEPLATE FOR AN ELECTROSTATIC PRINTING TUBE AND METHOD OF MAKING SAME

[75] Inventor: William W. Stein, Beaverton, Oreg.

[73] Assignee: Tektronix, Inc., Beaverton, Oreg.

[21] Appl. No.: 940,546

[22] Filed: Sep. 8, 1978

[51] Int. Cl.[2] ..... H01J 9/18; H01J 31/02

[52] U.S. Cl. ..... 313/419; 29/25.15

[58] Field of Search ..... 313/419; 29/25.14, 25.15; 346/158; 96/36.1; 427/64

[56] References Cited

U.S. PATENT DOCUMENTS

| | | | |
|---|---|---|---|
| 2,963,606 | 12/1960 | Crews et al. | 313/419 |
| 3,157,811 | 11/1964 | Stone, Jr. | 313/419 |
| 3,230,601 | 1/1966 | Wurtz | 29/25.14 |
| 3,321,657 | 5/1967 | Granitsas et al. | 313/419 |
| 3,366,817 | 1/1968 | Miller | 313/419 |
| 4,106,937 | 8/1978 | McTeague et al. | 427/64 X |

FOREIGN PATENT DOCUMENTS 1377187 12/1974 United Kingdom .

*Primary Examiner*—Palmer C. Demeo

[57] ABSTRACT

A method for making a faceplate for an electrostatic printing tube involves the positioning of the faceplate at an angle with respect to a collimated light source so that the pins embedded within the faceplate act as a mask to provide shadowed areas which prevent positive photoresist on a transparent conductive coating adhered to a surface of the faceplate from being exposed to light. The photoresist exposed to light is removed and the conductive coating is etched except where the nonexposed photoresist is located thereby forming elongated conductive pads electrically connected to respective pins. The nonexposed photoresist is removed and the conductive pads are plated with a suitable secondary electron emissive material.

7 Claims, 6 Drawing Figures

FACEPLATE FOR AN ELECTROSTATIC PRINTING TUBE AND METHOD OF MAKING SAME

BACKGROUND OF THE INVENTION

Faceplates for electrostatic printing tubes are provided with pins embedded in the glass as disclosed in U.S. Pat. Nos. 2,963,606 to Crews et al; 3,157,811 to Stone, Jr. and 3,230,601 to Wurtz. These pins extend from the inside surface of the faceplate to the outside surface and the focussed electron beam scans across the inner ends and impinges upon selected ones in accordance with beam operation and the movement of a printing medium along the outside surface of the faceplate. In this manner, information can be electrostatically written on the printing medium and subsequently toned and fixed thereon.

It is important that the sections of the pins on which the electron beam impinges have sufficient areas so that they are properly engaged by the electron beam. This is necessary due to the electron beam having a very accurate linear sweep so as to enable the beam to effectively engage the electron-beam engaging areas of the pins.

Crews et al. disclose a faceplate with inner ends of the pins having more area by slanting the pins in the faceplate. The drawback with this structure is the pins are secured in position between two different types of glass and this raises the capacitance which decreases the operating speed.

The faceplate in Stone, Jr. has etched conical recesses in the inner surface of the glass in communication with the respective pins, and these conical recesses and the inner surface of the glass are coated with a conductive coating with the coating on the recesses being thinner than on the inner surface. This structure is quite complicated and the pins are all electrically connected together.

The pins in Wurtz are located in a dielectric material which is used to fuse adjacent dielectric sheets together to form a faceplate. Inner ends of the pins extend outwardly from the faceplate and they are bent in engagement with the inner surface of the faceplate so as to provide a large area for beam engagement. The capacitance is increased due to the pins being disposed in a dielectric material having a dielectric constant that is higher than the adjacent dielectric sheets.

SUMMARY OF THE INVENTION

The present invention relates to faceplates for use in connection with an electrostatic printing tube and the method for making the same.

The present invention is realized by a method for making a faceplate for use in connection with an electrostatic printing tube wherein a series of pins are positioned in a single line at spaced intervals between dielectric members having the same dielectric constant and they extend from the front surface of the faceplate to the inner surface thereof. A thin coating of transparent conductive material is applied onto the inner surface in conductive engagement with the inner ends of the pins. Photoresist is coated onto the transparent conductive material and the faceplate is tilted relative to an axis of a collimated light source. Light is transmitted through the tilted face plate from the collimated light source and the pins acting as a mask prevent light from exposing the photoresist in the shadow areas defined by the pins. The photoresist exposed to light is washed away and the conductive coating is etched thereby removing it except where the nonexposed photoresist is located. The nonexposed photoresist is removed and the conductive areas thereunder are plated to form conductive pads for engagement by the electron beam when the faceplate is secured to a funnel section of a cathode ray tube.

An object of the present invention is to provide a faceplate for an electrostatic printing tube wherein the capacitance is reduced substantially as well as the required beam current.

Another object of the present invention is the provision of a faceplate for an electrostatic printing tube that provides improved image resolution.

A further object of the present invention is to provide a faceplate for an electrostatic printing tube that has conductive pads of increased area for ease of addressing the electron beam thereon thereby eliminating the need for an exact linear sweep.

An additional object of the present invention is to provision of a novel method of making a faceplate for use in connection with an electrostatic printing tube.

Other objects and advantages of the invention will be apparent upon consideration of the following specification taken in connection with the accompanying drawing.

DETAILED DESCRIPTION OF THE INVENTION

Figure 1:
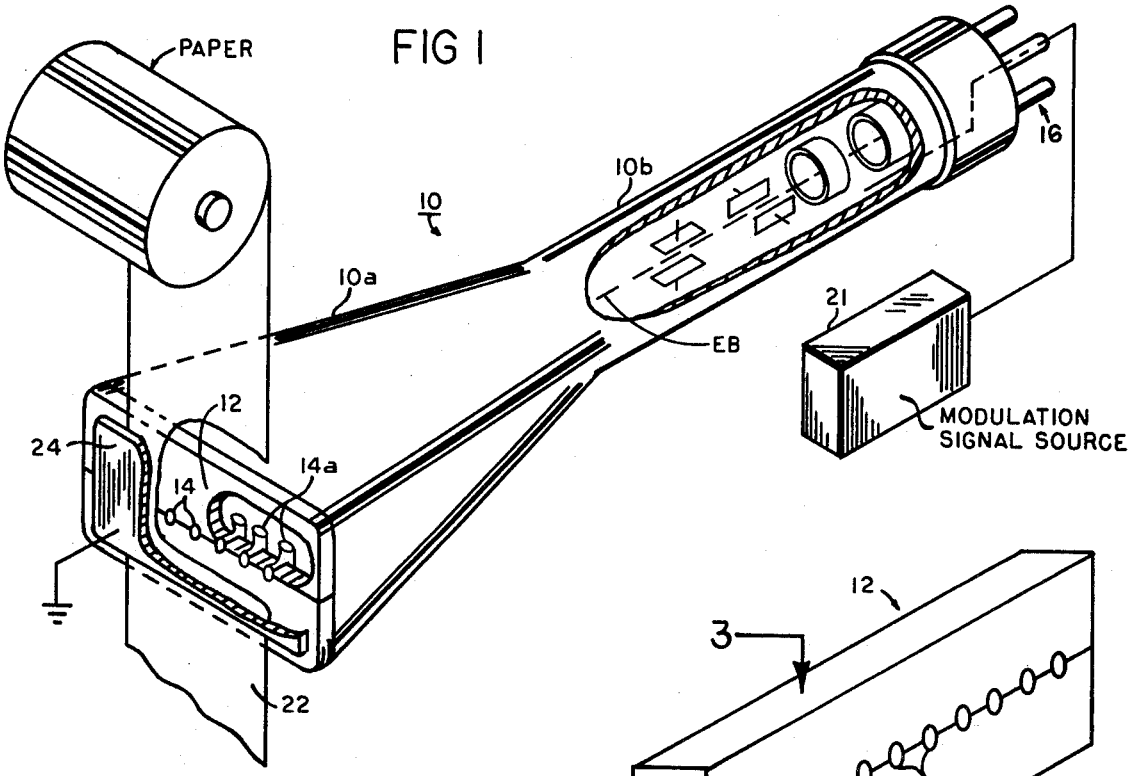
FIG. 1 is a perspective view with parts broken away of an electrostatic printing tube with the faceplate of the present invention thereon.
Figure 2:
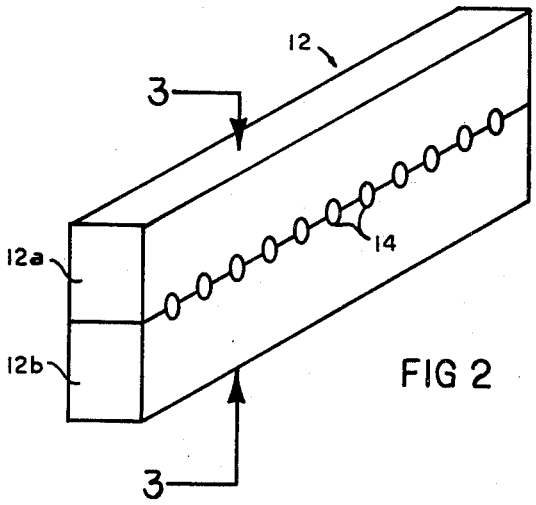
FIG. 2 is a perspective view of the faceplate.
Figure 3:
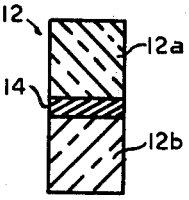
FIG. 3 is a cross-sectional view of FIG. 2 taken along line 3—3 of FIG. 2.
Figure 4:
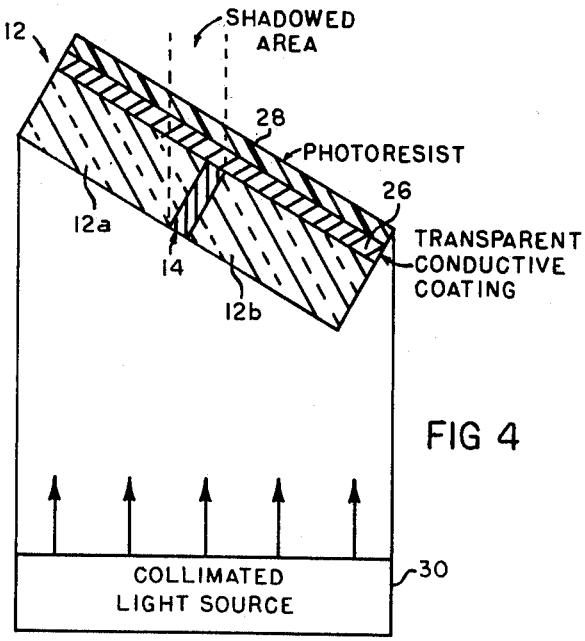
FIG. 4 is a cross-sectional view of a faceplate illustrating the fabrication of conductive pads on the inner surface of the faceplate.
Figure 5:
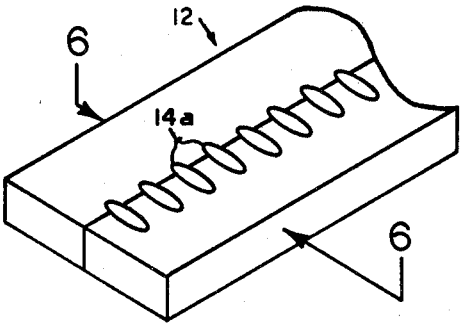
FIG. 5 is a part perspective view of the faceplate showing the conductive pads on the faceplate inner surface.
Figure 6:
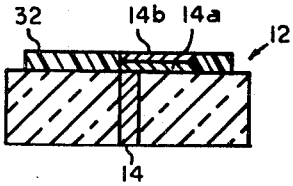
FIG. 6 is a cross-sectional view taken along line 6—6 of FIG. 5.

With reference to the drawings, FIG. 1 shows an electrostatic cathode ray printing tube 10 having a faceplate 12 sealed to a funnel section 10*a*. Faceplate 12 has a plurality of conductive pins 14 extending from an inner surface to an outer surface. Conductive pads 14*a* are disposed along the inside surface of faceplate 12 for engagement by the electron beam that is generated from a conventional electron gun and deflected by a conventional beam deflection structure in neck section 10*b* of the tube. The beam deflection structure is under control of modulation signal source 21 in accordance with conventional practice. Suitable connections to the gun electrodes and the deflection structure are made via pin connection assembly 16. External magnetic deflection coils may, of course, be employed.

Faceplate 12 as shown in FIGS. 2-6 includes low dielectric constant insulating sheets 12*a* and 12*b* of the same material which is preferrably low dielectric glass, e.g. soda lime glass between which wires, pins or conductive members 14 are sealingly embedded. Pins 14 are 1.5 to 2.5 mils by 0.25 mils cross section, they are spaced at 5 mils center to center from each other, and they are made of a suitable metal or metal alloy that has the same coefficient of expansion as sheets 12*a* and 12*b*.

When the conductive pads 14*a* inside the vacuum envelope are bombarded by electron beam EB, an electrostatic charge is developed in accordance with conventional practice and transmitted to the outer ends of pins 14.

As shown in FIG. 1, a dielectric material 22 such as paper is moved at a preselected rate past the outer ends of pins 14 and it is backed by a conductive plate 24 which is positioned contiguous to the remote side of paper 22 and adjacent faceplate 12 and is connected to ground. The depositing developing and fixing of a charge pattern on paper 22 is disclosed in U.S. Pat. No. 2,928,973 and need not be explained here.

Faceplate 12 is about 40 mils thick and it is cut from a block that was formed from larger sheets of 4"×9.4" that have been sealed together with one of the sheets having the conductive pins 14 formed thereon by conventional photographic and etching techniques. After faceplate 12 has been cut from the block, its surfaces are polished and a transparent coating 26 of conductive material such as tin oxide or induim tin oxide is deposited by vapor deposition or in any other suitable manner onto the surface of the faceplate that will be the inner surface. Coating 26 has a thickness of about 2000 angstroms or a thickness that will provide a conductivity of about 100 ohms per square or better.

A conventional positive photoresist 28 is provided onto coating 26 and faceplate 12 with its outer surface facing a collimated light source 30 is tilted at an angle relative to light source 30. The faceplate is maintained at this angle while light from light source 30 is directed through the glass 12*a*, 12*b*, transparent conductive coating 26 and into photoresist 28 except that part of photoresist 28 where pins 14 are located. Pins 14 provide shadowed areas along the faceplate and the length of these shadowed areas will depend upon the tilt angle of the faceplate relative to the light source and they will be nonexposed areas of the photoresist. An angle of 45° is the preferred angle.

The area of the photoresist that has been exposed to light will then be washed away by appropriate developing material e.g. AZ 303 developer provided by the Shipley Company exposing the conductive coating thereunder, and the nonexposed areas of the photoresist will be left behind on the conductive coating. The exposed conductive coating is then etched away by chemically etching with powered zinc and hydrochloric acid, or by sputtering and the nonexposed photoresist is washed from the remaining conductive areas of the conductive coating by AZ 1112 remover made by the Shipley Company on acetone. These conductive areas are conductive pads 14*a* that are in electrical engagement with the inner ends of the respective pins 14.

Conductive pads 14*a* are then plated with a suitable secondary emissive material 14*b* of about 5 microns thickness such as nickel, carbon black, P1 phosphor alkaline earth oxides such as MgO, BaO or the like. Plating can be done via conventional plating techniques such as for example electroplating or electrophoresis.

A thin phosphor layer 32 of preferrably P 31 phosphor of about one micron can be applied over the inner surface of the faceplate except where conductive pads 14*a*, 14*b* are located to enable alignment and focus of the electron beam with respect to the conductive pads. The completed faceplate is then sealingly secured onto the funnel section 10*a*.

If desired, two rows of pins 14 and conductive pads 14*a*, 14*b* can be provided in faceplate 12 in accordance with the foregoing to provide color presentation.

The fact that the pins are embedded in low dielectric constant glass will assure lower capacitance than if the pins were secured in the faceplate via frit or solder glass. This enables large conductive pads to be used for addressing the electron beam to the writing wires thereby eliminating the need for exact linear sweep while reducing the required beam current.

While a preferred embodiment of the present invention has been illustrated and described, it will be apparent that changes and modifications may be made to the invention without departing therefrom in its broad aspects. The appended claims therefore cover all such changes and modifications as fall therewithin.

The invention is claimed in accordance with the following:

1. A method of making a faceplate for use in connection with a cathode ray printing tube comprising the steps of:

applying a thin layer of transparent conductive material onto one surface of a glass member having conductive pins extending therethrough from said one surface to the other surface at spaced intervals therealong;

coating said conductive layer with a photoresist;

positioning said glass member relative to a collimated light source with the other surface facing said light source and said glass member being tilted at an angle relative to said light source so that said pins define a mask which masks light when light is transmitted from said light source through said glass member and transparent conductive layer into said photoresist thereby preventing exposure of said photoresist in these masked areas while the nonmasked area is exposed to the light;

washing away the exposed photoresist exposing the conductive layer thereunder;

etching away the exposed conductive layer from said one surface; and washing away the nonexposed photoresist thereby exposing conductive pads respectively electrically connected to said pins.

2. A method according to claim 1 which comprises the another step of plating said conductive pads with a secondary emissive material selected from the group consisting of nickle, carbon black, P1 phosphor, MfO and BaO.

3. A method according to claim 1 which comprises the further step of applying a thin phosphor layer onto said one surface except the conductive pads.

4. A method according to claim 3 which comprises the additional step of securing the faceplate to a cathode ray tube.

5. A faceplate for use in conjunction with a cathode ray tube comprising:

two sheets of low dielectric constant glass having surfaces to be sealingly secured together thereby forming a single glass sheet;

electrically conductive pins that are sealingly embedded within said surfaces when said sheets of glass are sealingly secured together; said conductive pins being spaced from each other along said single glass sheet and extending from one outside surface to the other outside surface of said single glass sheet with ends of said conductive pins being exposed and substantially coplanar with said outside surfaces; and planar electrically conductive pads engaging and extendig along one of said outer surfaces substantially at right angles with respect to said conductive pins, said conductive pads being spaced from each other and each of said conductive pads being electrically connected to an exposed end of a respective one of said conductive pins, said conductive pads being formed on said one of said outer surfaces by using said conductive pins to fix photoresist disposed on a transparent conductive layer by shining light through said single glass sheet which is titled at an angle relative to said light source and removing the transparent conductive layer not covered with fixed photoresist thereby leaving said conductive pads on said one of said outer surfaces in electrical connection with their respective conductive pins.

6. A faceplate according to claim 5 wherein said conductive pads have a layer of secondary emissive material thereon which is selected from the group consisting of nickel, carbon black, P1 phosphor, MgO and BaO.

7. A faceplate according to claim 5 wherein said faceplate has a thin layer of phosphor material on said inner surface except where said conductive pads are located.

* * * * *